United States Patent [19]

Sawyer

[11] 4,418,246

[45] Nov. 29, 1983

[54] CELL ASSEMBLY FOR ELECTRET TRANSDUCER

[75] Inventor: Joseph A. Sawyer, Camden, Me.

[73] Assignee: Tibbetts Industries, Inc., Camden, Me.

[21] Appl. No.: 201,787

[22] Filed: Oct. 29, 1980

[51] Int. Cl.[3] ..... H04R 31/00

[52] U.S. Cl. ..... 179/111 E; 179/115.5 ES; 179/181 R

[58] Field of Search ..... 179/111 E, 115.5 ES, 179/181 R, 181 F, 181 W; 307/400

[56] References Cited

U.S. PATENT DOCUMENTS

| | | | |
|---|---|---|---|
| Re. 28,420 | 5/1975 | Murphy | 179/111 E |
| 3,740,496 | 6/1973 | Carlson et al. | 179/111 E |
| 3,772,133 | 11/1973 | Schmitt | 161/112 |
| 3,784,772 | 1/1974 | Nelson | 200/83 Y |
| 3,895,194 | 7/1975 | Fraim | 179/121 R |
| 4,063,050 | 12/1977 | Carlson et al. | 179/111 E |
| 4,070,741 | 1/1978 | Djuric | 29/25.42 |
| 4,142,073 | 2/1979 | Agneus et al. | 179/111 E |
| 4,160,881 | 7/1979 | Smulders | 179/111 E |

FOREIGN PATENT DOCUMENTS

| | | | |
|---|---|---|---|
| 7802691 | 9/1979 | Netherlands | 179/111 E |
| 7410408 | 4/1976 | Sweden . | |

*Primary Examiner*—G. Z. Rubinson
*Assistant Examiner*—Robert Lev
*Attorney, Agent, or Firm*—Kenway & Jenney

[57] ABSTRACT

The vibratable diaphragm of an electret transducer has in its central plate portion one or more formed ribs, ridges or projections resting of a substantially flat backplate. These support the active regions of the diaphragm with precise spacing from the backplate. Elongate projections can be formed to relieve membrane stresses in the diaphragm. The flexural stiffness of the diaphragm is sufficient in itself to provide mechanical stability of the diaphragm in the presence of the destabilizing forces of electrostatic attraction by the backplate.

10 Claims, 13 Drawing Figures

FIG. 1
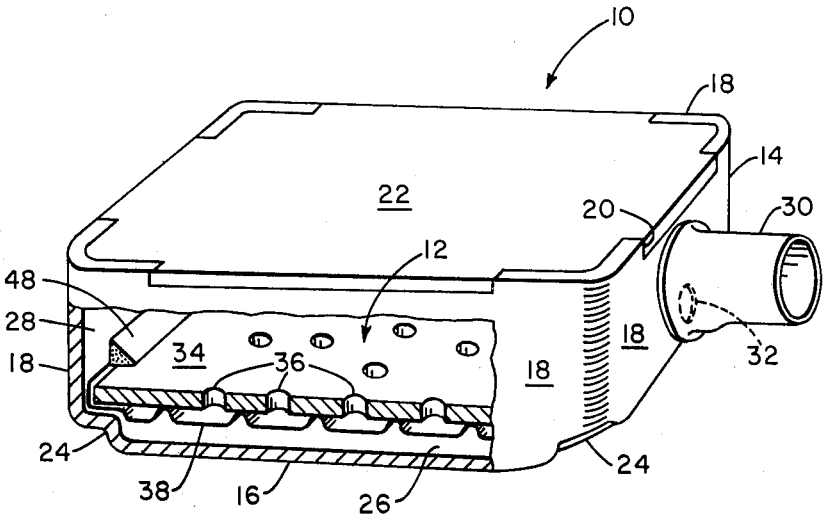
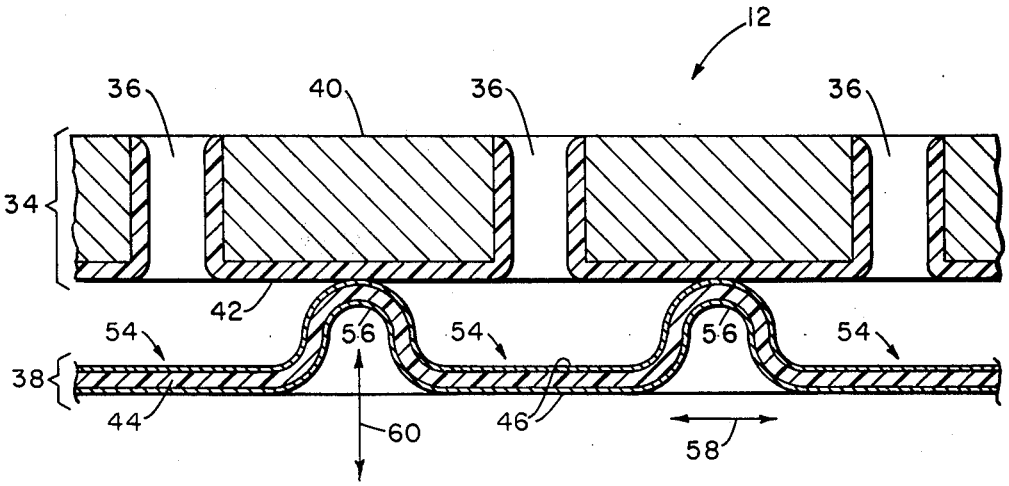
FIG. 2

FIG. 3
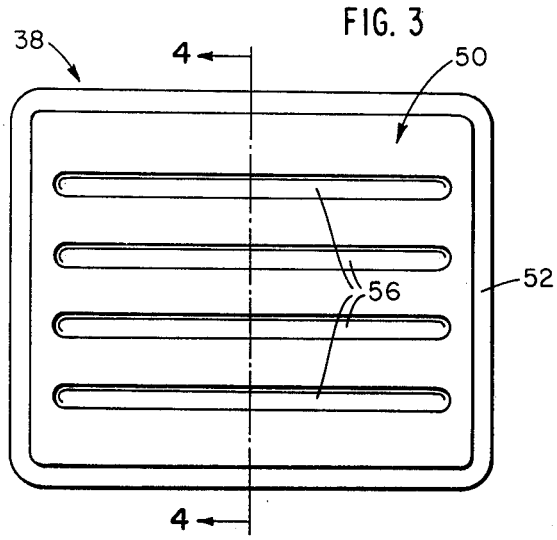
FIG. 5
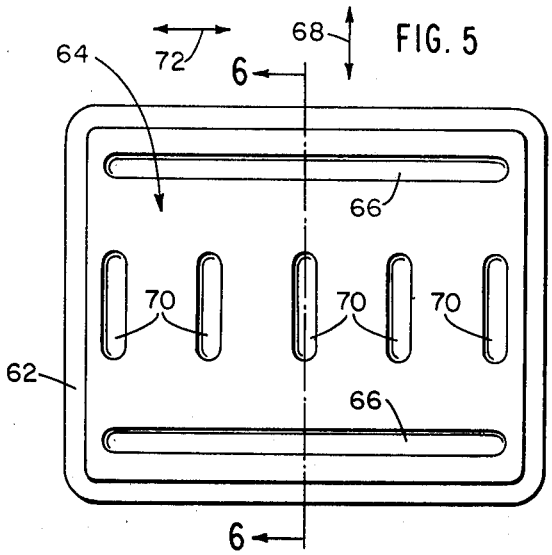
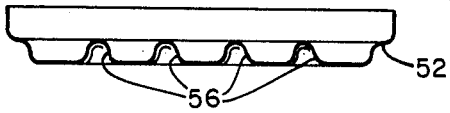
FIG. 4
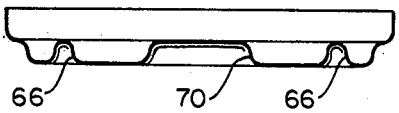
FIG. 6
FIG. 7
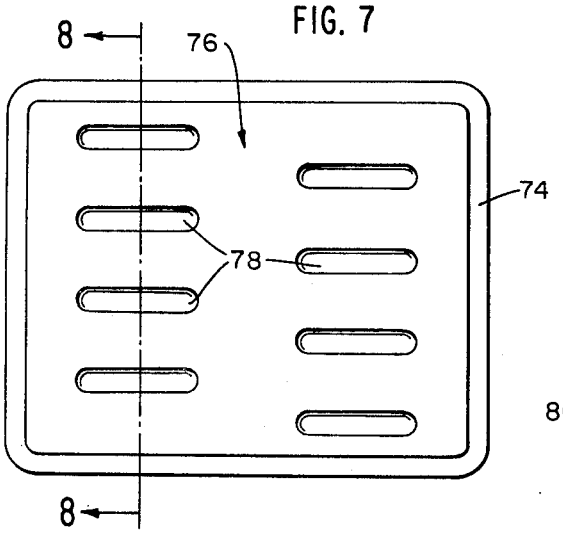
FIG. 9
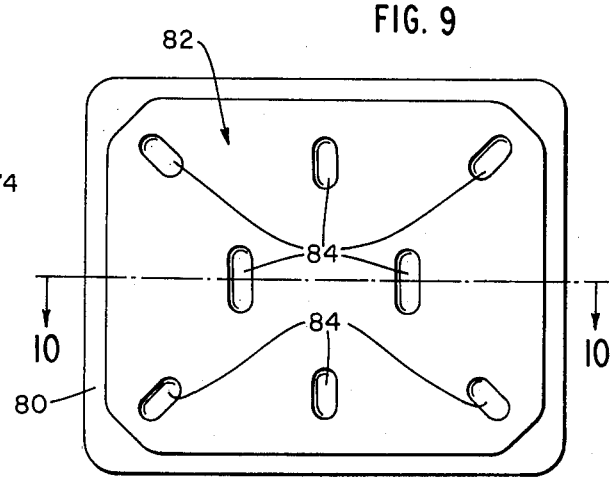
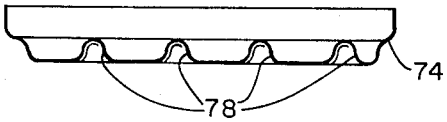
FIG. 8
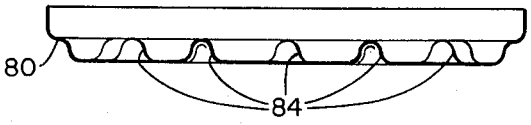
FIG. 10

FIG. 11
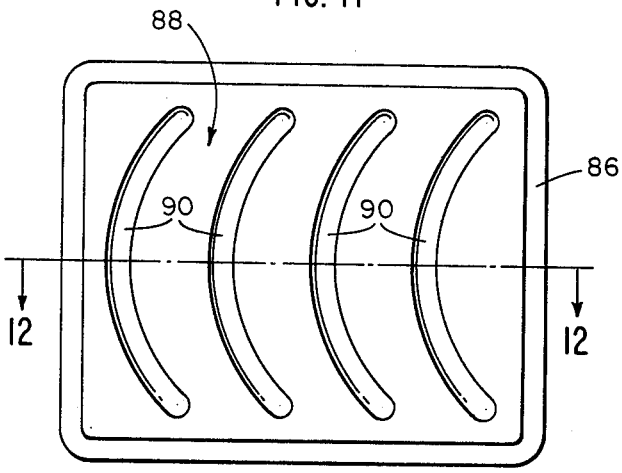
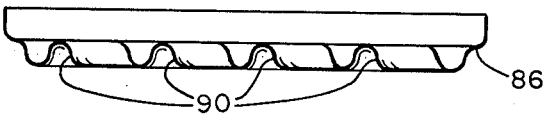
FIG. 12
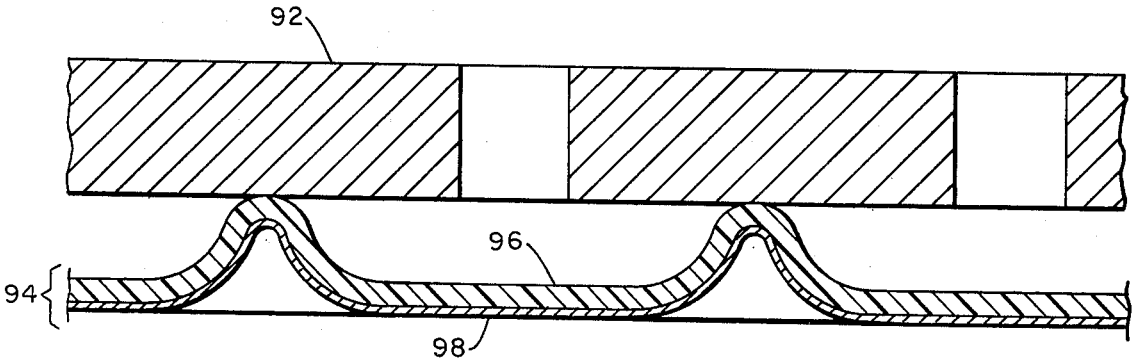
FIG. 13

CELL ASSEMBLY FOR ELECTRET TRANSDUCER

SUMMARY OF THE INVENTION

This invention relates generally to electret transducers, and more particularly to such transducers in which flexural stresses in the diaphragm comprise the major forces tending to restore it to its free, undeflected position.

In electret condenser transducers there is a diaphragm which is spaced from and vibrated with respect to a backplate. Typically, the diaphragm has a metal layer or film facing the backplate and the backplate has on its surface a layer or film of electret material on which an electrostatic charge is developed. Alternatively, the electret material may be on the surface of the diaphragm facing the backplate. The prior art methods for providing mechanical stability of the diaphragm divide into two basic approaches. In the one, the mechanical restoring forces tending to return the diaphragm to its free position are provided primarily by membrane stresses in the diaphragm. Commonly, the diaphragm and its support are fabricated so that the membrane stresses are large when the diaphragm is undeflected; that is, the diaphragm is prestressed in a manner analogous to a drum head. In the other approach, the restoring forces necessary for mechanical stability are provided largely by flexural stresses in a diaphragm plate which are developed as the diaphragm plate deflects from its free position. In both approaches it is important to maintain a precise location of the diaphragm in relation to the backplate, and multiple spaced supports to the diaphragm surface are provided for this purpose as exemplified by U.S. Pat. No. 3,740,496 issued June 19, 1973 to Carlson, et al.

A principal object of this invention is to provide improvements in transducers of the second basic type mentioned above. In such transducers the intention is that membrane stresses, that is, tension stresses in any direction parallel to the superficial planes of its principal surfaces, which stresses tend to develop when the diaphragm deflects from its free position, shall remain small and shall not contribute significantly to the mechanical stability of the diaphragm. As suggested by the above-mentioned patent, the relative dimensions of a diaphragm change as a function of temperature, humidity and aging and, accordingly any tension stress in the diaphragm is a function of and varies with the foregoing parameters. It is for these reasons that reliance for mechanical stability is preferably placed upon flexural stresses since mechanical stiffness of the diaphragm plate is relatively insensitive to the above-stated parameters.

In practice, however, transducers intended to depend primarily upon flexural stresses for mechanical stability often have a high sag characteristic; that is, in such transducers of the prior art, the diaphragm sags toward the backplate as the result of electrostatic attraction. The sag is often a relatively large fraction of the air gap that would exist if the diaphragm were in its free, undeflected position and the electret surface were not charged. In a typical embodiment having multiple spaced supports to the diaphragm surface, the high sag shapes the diaphragm into a multiply-dimpled shell in which the active regions of the diaphragm between the supports develop local membrane stresses that increase progressively as such regions sag toward the backplate. Thus the diaphragm is self-stiffened in part by undesirable membrane stresses. It is therefore a related object of this invention to provide an improved structure having a diaphragm with low sag characteristics.

It is a further object of this invention to provide an improved structure having means for relieving such membrane stresses as may occur, of whatever origin such as electrostatic sag or changes of temperature, humidity or aging, thereby to limit any effect of membrane stress changes upon the operating characteristics of the transducer. Concomitantly with the relief of membrane stresses, the transducer structure can become one in which flexural stresses in the diaphragm are adequate in themselves to provide mechanical stability to the diaphragm in the presence of the destabilizing forces of electrostatic attraction.

It is a still further object of this invention to provide an electret transducer having a flat or essentially flat backplate. In the prior art the backplate is often formed to provide the spacing projections and has an irregular surface upon which an electret film may be laminated. The irregular surface increases the difficulty of laminating the electret material due to the potential of air entrapment around the projections, and an inconsistent lamination may result. With a flat or essentially flat backplate the electret film can be more readily and consistently laminated. A flat electret surface is also easier to charge and the charge density is more uniform than would be the case with an electret surface having projections extending therefrom.

With the above and other objects hereinafter appearing in view, the features of this invention include a highly supported, low sag diaphragm structure characterized by one or more ribs, ridges or projections in its central plate portion resting on the backplate. These support the diaphragm with precise spacing from the backplate and may be formed to relieve membrane stresses in the plate portion. The ribs, ridges or projections have a relatively small total effective area of contact with the backplate compared with the area of the entire plate portion. For this reason the electroacoustic sensitivity of the transducer is not unduly attenuated as the result of electrical leakage capacitance associated with the support regions.

In certain embodiments according to the invention, the active portions of the diaphragm are arranged in elongate strips thereby further minimizing the development of membrane stresses in the diaphragm as it deflects. Generally, these strips are elongate in directions transverse to the stress relieving directions of the formed supporting projections in the diaphragm.

DESCRIPTION OF THE DRAWINGS

FIG. 1 is an isometric projection, partly in cross-section, of an electret transducer in accordance with this invention.

FIG. 2 is a fragmentary elevation in section showing details of the diaphragm and backplate assembly.

FIG. 3 is a bottom plan view of a first embodiment of the diaphragm.

FIG. 4 is an elevation in section taken on line 4—4 of FIG. 3.

FIG. 5 is a bottom plan view of a second embodiment of the diaphragm.

FIG. 6 is an elevation in section taken on line 6—6 of FIG. 5.

FIG. 7 is a bottom plan view of a third embodiment of the diaphragm.

FIG. 8 is an elevation in section taken on line 8—8 of FIG. 7.

FIG. 9 is a bottom plan view of a fourth embodiment of the diaphragm.

FIG. 10 is an elevation in section taken on line 10—10 of FIG. 9.

FIG. 11 is a bottom plan view of a fifth embodiment of the diaphragm.

FIG. 12 is an elevation in section taken on line 12—12 of FIG. 11.

FIG. 13 is a fragmentary elevation in section showing details of an alternative form of diaphragm and backplate assembly.

DETAILED DESCRIPTION

FIG. 1 shows an electret transducer generally designated at 10 incorporating an electret cell assembly 12 according to this invention. The transducer has a cup-like case 14 which in this embodiment is rectangular in shape having a bottom wall 16 and four side walls 18 integral therewith. The case is preferably made of sheet metal and stamped or otherwise suitably formed in the configuration shown. Notches 20 are formed in the upper edges of the walls 18 to receive a flat metal cover 22 having a periphery suitably shaped for a close fit therein.

Corner projections 24 are provided adjacent the bottom wall 16, in this case by inwardly deforming the case to provide surfaces spaced from the bottom wall upon which to rest the electret cell assembly 12, thereby creating two acoustic cavities 26 and 28. A suitable means for acoustic communication between the cavity 26 and the outside is provided by a flared tube 30 welded to a wall 18, said wall having a hole 32 communicating between the cavity 26 and the tube. As stated above, the electret cell assembly 12 is mounted in the case resting on the corner projections 24 which space it from the bottom of the case. This assembly comprises a flat, rigid backplate 34 having a plurality of mutually spaced holes 36 through it, and a diaphragm 38. The holes 36 communicate between the acoustic cavity 28 and the space between the diaphragm and the backplate as shown in FIG. 2. The backplate 34 preferably comprises a sheet 40 of suitable metal upon the surface of which, facing the diaphragm, is laminated an electret film 42. This film is a charged material of any commonly used type, for example the copolymer of tetrafluoroethylene and hexafluoropropylene commonly sold under the trademark Teflon FEP. Preferably, the film 42 also coats the walls of the holes 36. The diaphragm preferably comprises a flexible polymeric sheet 44 of suitable material such as polyethylene terephthalate commonly sold under the trademark Mylar, both surfaces of the sheet being coated with metalized layers 46 of conductive material.

The transducer assembly also includes electrical circuit components suitably mounted within the acoustic cavity 28 and lugs or other fittings on a wall 18 for electrical connection to external circuits, these components being of a conventional form and being therefore omitted from the drawing for the sake of clarity of description. The circuit components have a pair of electrical connections to the cell assembly, namely a first connection to the sheet 40 of the backplate and a second connection to either or both of the metalized layers 46 on the diaphragm.

A fillet 48 of adhesive secures the electret cell assembly 12 in position within the case 14. An atmospheric vent or acoustic impedance, for clarity not shown in the drawing, may interconnect the acoustic cavities 26 and 28.

FIG. 3 is a bottom plan view of the diaphragm 38. The diaphragm comprises a central vibratable plate portion 50 and an edge portion 52 around the periphery of the plate portion. The edge portion is formed down to rest on the backplate about the circumference of the diaphragm as shown in FIG. 1, providing support for the diaphragm. The edge portion is further formed to fit closely over the edge of the backplate 34 as also shown in FIG. 1, thereby accurately locating the diaphragm on the backplate.

The central vibratable plate portion 50 comprises a number of active regions 54 separated by formed elongate corrugations, ribs or ridges 56, hereinafter referred to generically as "projections." The plate portion 50 may contain one or a plurality of the projections 56, which act to relieve membrane stresses in the plate portion that develop upon deflection thereof from its free position or for any other reason. The illustrated projections have their principal dimensions extending in substantially parallel directions. The projections are operative to relieve membrane stresses in the directions at right angles to their principal dimensions, as indicated by the arrows 58 in FIG. 2. However, the projections 56 have considerable mechanical stiffness in the direction indicated by the arrows 60, and serve accurately to space the active regions 54 of the plate portion from the electret film 42. The inherent flexural stiffness of the diaphragm is sufficient to provide a strong resistance against the tendency of the active regions 54 to sag toward the charged electret film 42 in the completed assembly.

In this embodiment the active regions 54 are configured as elongate strips in which end effects are relatively unimportant, further minimizing the development of membrane stresses in the diaphragm active regions as they deflect. As shown, the strips are arranged transversely of the stress relieving directions of the formed projections or supports 56.

The projections 56 are formed so that the total effective area of contact between the projections and the backplate (the equivalent area that in planar contact with the backplate would have the same electrical capacitance as the actual projections) is small compared to the total area of the plate portion 50. These criteria ensure that the leakage capacitance in the regions of the projections will be held to a practical minimum, thereby avoiding an excessive reduction in the sensitivity of the transducer, while at the same time the plate portion is highly supported by the projections.

FIGS. 5 and 6 show a second embodiment of the diaphragm. This comprises an edge portion 62 and a vibratable central portion 64. The central portion contains elongate projections 66 providing membrane stress relief in the directions indicated by arrows 68, and projections 70 that are elongate in directions at right angles to the projections 66, providing membrane stress relief in the directions of arrows 72.

FIGS. 7 and 8 show a third embodiment of the diaphragm, comprising an edge portion 74 and a vibratable central portion 76. Elongate projections 78 are arranged in two staggered rows.

FIGS. 9 and 10 illustrate a fourth embodiment of the diaphragm, comprising an edge portion 80 and a vibratable central portion 82. A number of short projections 84 are evenly distributed over the area of the central portion 82 so that the spacing of the projections, in conjunction with the self-stiffness of the diaphragm, will substantially resist the tendency to sag in response to electrostatic attraction by the backplate. Short projections of the kind illustrated, or round projections with substantially point contact with the backplate, may be used where it is less important to provide membrane stress relief than to provide means to control sag.

FIGS. 11 and 12 illustrate a fifth embodiment of the diaphragm, comprising an edge portion 86 and a vibratable central portion 88. A number of curved projections 90 are substantially equally spaced within the vibratable central portion 88.

FIG. 13 illustrates another embodiment of the cell assembly. This includes an uncoated metallic backplate 92 and an electrode electret diaphragm 94. The diaphragm 94 includes a charged electret film 96 and a metalized electrode layer 98 on the side of the diaphragm 94 facing away from the backplate. The external circuit components are connected to and between the backplate and the electrode layer 98. In this embodiment the electret film 96 performs simultaneously the functions of electret film 42 and diaphragm sheet 44 of FIG. 2.

In each of the illustrated embodiments the projections defining the supports for the diaphragm serve also to define the active diaphragm regions, to locate these regions accurately with respect to the backplate, and to act in conjunction with the self-stiffness of the diaphragm to resist sag in these regions as previously described. By appropriate configuration of the projections, they may also act to relieve membrane stresses in the diaphragm that result from any condition. Consequently, such stresses play a minimal role in providing forces tending to restore the vibratable diaphragm regions to their free, undeflected position, and such restoring forces are provided primarily by flexural stresses in the diaphragm. As a result, the transducer characteristics are less sensitive to conditions such as changes in temperature, humidity and aging, as well as sag caused by electrostatic forces induced by the charged electret. These conditions would otherwise cause changes in the operating characteristics of the transducer through changes in membrane stresses acting in the diaphragm.

I claim:

1. A cell assembly for an electret transducer comprising, in combination, a substantially flat backplate, and a diaphragm formed of flexible sheet material and including a central plate portion and an edge portion around the periphery of the plate portion and attached to the backplate, the plate portion having at least one corrugation therein located inwardly of and spaced from the edge portion and being formed to protrude from the superficial plane of a principal surface of the plate portion, said at least one corrugation having a curved protruding surface thereof resting directly upon the backplate, defining at least one vibrationally active region of the plate portion and supporting said at least one active region against electrostatic collapse and with precise spacing from the backplate, said at least one corrugation having a principal dimension extending in a direction parallel to said superficial plane and being configured to relieve membrane stress in the plate portion directed transversely to said direction, said at least one corrugation having a total area of contact with the backplate that is small compared to the total area of said plate portion, one of said backplate and plate portion comprising an electret material.

2. A cell assembly according to claim 1, in which the backplate comprises a substantially flat sheet and a film of charged electret material laminated thereon facing the plate portion.

3. A cell assembly according to claim 2, in which the plate portion comprises a flexible sheet having an electrode layer thereon facing the backplate.

4. A cell assembly according to claim 1, in which the plate portion comprises a charged electret film having an electrode layer thereon facing away from the backplate.

5. A cell assembly according to claim 1, in which the regions of the plate portion adjacent the said at least one corrugation have sufficient flexural stiffness substantially to limit sag therein resulting from electrostatic attraction to the backplate.

6. A cell assembly according to claim 1, in which said edge portion is formed to rest on the backplate and to support the plate portion thereon.

7. A cell assembly according to claim 1 having a plurality of spaced elongate corrugations in the plate portion each resting on the backplate and adapted to relieve membrane stress in the plate portion.

8. A cell assembly according to claim 7, in which the regions of the plate portion between the corrugations are configured as elongate strips.

9. A cell assembly according to claim 7, in which the principal dimensions of the corrugations extend in substantially parallel directions.

10. A cell assembly according to claim 1, in which the backplate is perforated.

* * * * *